United States Patent [19]

Groebli et al.

[11] Patent Number: 4,979,887

[45] Date of Patent: Dec. 25, 1990

[54] PELLET MILL

[75] Inventors: Werner Groebli, Flawil; Hugo Hegelbach, Busswil; Willi Wetzel, Uzwil, all of Switzerland

[73] Assignee: Gebrueder Buehler AG, Uzwil, Switzerland

[21] Appl. No.: 282,279

[22] Filed: Dec. 7, 1988

[30] Foreign Application Priority Data

Dec. 18, 1987 [DE] Fed. Rep. of Germany ..... 3743037

[51] Int. Cl.[5] ..... B28B 3/18

[52] U.S. Cl. ..... 425/135; 425/171; 425/182; 425/186; 425/191; 425/192 R; 425/331; 425/365

[58] Field of Search ..... 425/186, 191, 400, 450.1, 425/451.3, 451.7, 451.9, 135, 169, 171, 182, 190, 192 R, 193, 331, 365

[56] References Cited

U.S. PATENT DOCUMENTS

| | | | |
|---|---|---|---|
| 2,177,132 | 10/1939 | Crabtree | 425/193 |
| 2,620,756 | 12/1952 | Krens | 425/191 |
| 2,879,545 | 3/1959 | Bailey | 425/451.7 |
| 2,984,176 | 5/1961 | Sommer et al. | 425/451.9 |
| 3,559,238 | 2/1971 | Gilman | 425/186 |
| 3,593,391 | 7/1971 | Routh | 425/191 |
| 3,632,279 | 1/1972 | Christy et al. | 425/451.7 |
| 3,663,027 | 5/1972 | Klipping | 425/451.9 |
| 3,702,751 | 11/1972 | Mehnert | 425/190 |
| 3,865,534 | 2/1975 | Mori | 425/451.9 |
| 3,981,664 | 9/1976 | Bittner et al. | 425/DIG. 230 |
| 3,981,665 | 9/1976 | Spencer | 425/DIG. 230 |
| 4,017,236 | 4/1977 | Penkman et al. | 425/451.9 |
| 4,017,239 | 4/1977 | O'Connell et al. | 425/451.9 |
| 4,022,563 | 5/1977 | Spencer | 425/331 |
| 4,226,578 | 10/1980 | Grobli et al. | 425/190 |
| 4,260,358 | 4/1981 | Mehnert | 425/451.3 |
| 4,370,116 | 1/1983 | Groom | 425/450.1 |
| 4,515,544 | 5/1985 | Boehm et al. | 425/129.1 |
| 4,537,570 | 8/1985 | Black et al. | 425/450.1 |
| 4,702,456 | 10/1987 | Von Holdt | 425/451.9 |
| 4,718,845 | 1/1988 | Sheffield et al. | 425/450.1 |

FOREIGN PATENT DOCUMENTS

| | | | |
|---|---|---|---|
| 0192484 | 8/1986 | European Pat. Off. | 425/450.1 |
| 1806301 | 6/1969 | Fed. Rep. of Germany | 425/186 |
| 1115893 | 4/1956 | France . | |
| 421019 | 3/1947 | Italy | 425/191 |
| 42-22305 | 11/1967 | Japan | 425/450.1 |
| WO85-02363 | 6/1985 | PCT Int'l Appl. | 425/451.9 |
| 358187 | 12/1972 | U.S.S.R. | 425/451.9 |

*Primary Examiner*—Jay H. Woo
*Assistant Examiner*—James P. Mackey
*Attorney, Agent, or Firm*—Martin A. Farber

[57] ABSTRACT

A pellet mill comprises a perforated annular pellet die having an axis of rotation and first and second ends; and a die carrier rotatable about an axis of rotation and having an annular recess for receiving the first end of the annular pellet die. Fixing devices are secured to the first end of the die and cooperating fixing devices are provided in the annular recess in the die carrier. The fixing devices and the cooperating fixing devices have a first position relative to one another permitting insertion of the first end into the annular recess by relative axial movement of the die and die carrier and a second relative position permitting the transmission of force between the fixing devices and the cooperating fixing devices to draw the die towards the die carrier into a clamped position. Various different devices are provided for generating the force. In addition centering devices are provided which are effective on drawing of the die towards the die carrier to center the die relative to the die carrier. The pellet mill also includes a device for releasing the die from the die carrier.

62 Claims, 8 Drawing Sheets

PELLET MILL

The invention relates to a pellet mill of the kind comprising a perforated annular pellet die which is mounted on a die carrier and rotatable about an axis of rotation, with rollers being provided inside said annular pellet die which press viscous pellet material out through the perforations in the die to form pellets. Such dies are used in particular for forming pellets of animal feed but can also be used to press other materials.

Depending on the material to be processed and the use for which the pellets are intended it is necessary to connect various dies with the pellet mill. In general the fastening of the die to the die carrier is achieved either by using several bolts or set screws which are distributed around the periphery of the die, or by using clamping rings which are secured to the die carrier with the aid of screw-threaded fasteners. This has however the consequence that on mounting the die on the die carrier great care must be paid to ensure that the die and die carrier are mounted precisely coaxial to one another, whereupon the various bolts have to be uniformly tightened. This naturally requires a not inconsiderable expenditure of time and effort.

The fact is however, that for smaller batches a relatively frequent change of the dies or matrixes is necessary so that it is desirable to shorten this working step.

However, a troublefree form-fitted connection between the die and the die carrier is difficult to achieve, simply by reason of the prevailing circumstances (dimensions and weight, wear). Indeed it is even more difficult to maintain such a troublefree form-fitted connection during operation, since the temperature difference between a cold die which is to be newly mounted and the die carrier which has been heated in operation can lead to considerable dimensional differences which are only compensated for once the temperature of the two parts has been matched. In addition to this one has to take account of the vibrations which are unavoidable in operation, and which can lead to loosening of the connection and indeed eventually to fracture of the die.

The form-fitted connection can admittedly be improved when the die and/or the die carrier, or a part connected therewith have a conical surface, however this still assumes a precise axially parallel insertion of the two cone parts. In general this is however difficult having regard to the high weight of the die so that the danger of tilting exists.

By way of example constructions of the above described kinds can be found in the French publication 1115 893 and in the U.S. Pat. Nos. 4,022,563 and 4,226,578. Even though these arrangements provide an improved form-fitted connection, they cannot guarantee axially parallel tilt-free assembly of the die onto the die carrier. Moreover, a considerable amount of effort and work was then necessary in order to secure the die with the aid of threaded bolts.

The invention is primarily based on the object of providing a pellet mill in which the dies can be rapidly and reliably interchanged with little working effort.

This object can in particular be realised by a pellet mill comprising a perforated annular pellet die having an axis of rotation and first and second ends; a die carrier rotatable about an axis of rotation and having an annular recess for receiving said first end of said annular pellet die; fixing means secured to said first end of said die and cooperating fixing means provided in said annular recess in said die carrier, said fixing means and said cooperating fixing means having a first position relative to one another permitting insertion of said first end into said annular recess by relative axial movement of said die and die carrier and a second relative position permitting the transmission of force between said fixing means and said cooperating fixing means to draw said die towards said die carrier into a clamped position; means for generating said force; centering means effective on drawing of said die towards said die carrier to center said die relative to said die carrier; and means for releasing said die from said die carrier.

With an arrangement of this kind the fixing means and the cooperating fixing means can readily be laid out so that the die is centered as it is drawn into the die carrier, and indeed without the need to worry about the die tilting. Embodiments can bring about a particularly rapid and simple assembly of the die on the die carrier.

The means for generating the force required to draw the die towards the die carrier into a clamped position can be generated in various ways.

One possibility is to use spring loaded pins for the cooperating fixing means. In an arrangement of this kind the fixing means comprise a plurality of undercut apertures provided in an end/face of the annular pellet die and the cooperating fixing means in the form of the aforementioned plurality of the pins is disposed at least substantially parallel to the axis of the pellet die, with the heads of the pins being engagable in the first relative position within said apertures. The pins can then be rotated into the second relative position in which the heads engage behind the apertures and spring force then used to draw the pins into the die carrier and thus the die into the clamped position. The springs can be permanently arranged on the pins and hydraulic piston-in-cylinder units can be used, to compress the springs and to prevent them from acting on the pins in the first relative position. After insertion of the die, the piston-in-cylinder units can progressively disengage from the springs allowing the springs to draw the pins rearwardly.

This rearward movement can also be converted by a cam and slot mechanism into a rotation of the pins about their axes whereby the heads of the pins enter into the second relative position during the movement of the pins, in particular during the initial stages of movement of the pins.

Since the pins are spring loaded, e.g. by plate springs, they are held in their operational position even if the hydraulic circuit should fail completely during operation of the mill. This is one advantage of using hydraulic power only to release the pins or holding members but not to engage them.

In arrangements of this kind where axially actuatable fixing members are engagable in a recess of the die and can be turned so that they are in form-locked connection with the die, one obtains a particularly simple apparatus with which the die can be drawn against the die carrier. At the same time the transmission of the torque between the die carrier and the die can be effected by elements of relatively small dimensions and the double movement is also achievable using a single drive.

If the rotary guide for the fixing members, for example the pins, has lateral locations at its two ends, in particular end portions extending parallel to the axial direction then a particularly simple kinematic arrangement is present both for the mounting of the die and also the fixing of the die to the die carrier.

Furthermore, if the die has projecting centering parts in the region of one axial end, in particular centering parts which are distributed around the periphery, with these centering parts cooperating with the annular recess of the die carrier, or a recess formed by an insert in the annular recess of the die carrier, then one can achieve a force locked connection between the die and the die carrier in a particularly simple manner, and indeed a force locked connection which can be subjected to high forces. This is particularly true if the fixing means takes the form of a ring rail mounted at one end face of the die into which the cooperating fixing means engage, with the centering parts being formed by the ring rail. This arrangement in which the rail provides, on the one hand, apertures for receiving the heads of the cooperating fixing means and, on the other hand, also provides the centering part or parts, leads to a particularly simple construction with a low number of parts.

In an alternative embodiment the fixing means comprises screw thread means provided at the first end of the die and the cooperating fixing means comprises cooperating screw thread means provided in the annular recess. In a particularly preferred embodiment the screw thread means comprises a threaded ring at said first end of said die and said cooperating screw thread means comprises a plurality of arcuate screw threaded segments provided within said annular recess. This arrangement permits axial insertion of said first end of said die into said annular recess in a first relative position, in which the threaded ring at said first end of said die is aligned with threaded segments in said recess, and subsequent relative rotational movement into said second relative position by rotation of said threaded ring at said first end of said die relative to said threaded segments in said annular recess, with said die being simultaneously drawn towards said die carrier into said clamped position by the cooperating threads at said first end of said die and in said annular recess.

The pitch of the cooperating screw threads serves, on rotation of the die relative to the die carrier, which can be achieved with a relatively small force, to generate a substantial mechanical advantage for pulling the die into the die carrier into clamped engagement therewith.

In both these embodiments conical surfaces can readily be used to produce centering of the die on the die carrier during the axial movement thereof.

In all these embodiments the axially movable fixing means have the advantage that they not only serve for the attachment of the die to the die carrier but also simultaneously represent an assembly aid by which the die is drawn against and into the die carrier. Since the centering takes place during relative movement of the die and die carrier friction between the die and die carrier, is relatively low at this stage and there is substantially less danger of tilting of the die carrier arising. Moreover, should any loosening of the die relative to the die carrier tend to occur during operation, for example due to thermal expansion of a cold die after mounting on a warm die carrier, this will be automatically compensated for since either the springs will then once again pull the die tighter against the die carrier or, if a screw thread is used, any relative rotational slippage between the die and the die carrier will once again result in tightening of the die against the die carrier, provided the cooperating threads are correctly handed.

In a particular preferred embodiment the threaded ring at the end of the die is replaced by individual threaded segments, or only segments of the ring are threaded. With this arrangement the threaded segments on the die can be inserted axially into the gaps between the threaded segments in the annular recess (first relative position) and then rotated (into the second relative position) to produce engagement between the screw threads with simultaneous drawing of the die onto the die carrier. In other words an embodiment is possible which is constructed in the manner of a bayonet connection. With a connection of this kind particularly high forces can then be transferred between the die and the die carrier and a form-locked connection is readily achieved after only a small rotational movement. Such rotational connections are for example customary in the artillery field, where high axial loadings occur.

If the thread or threaded segments are releasably connected to the die and/or die carrier, in particular via screws, then it is possible to interchange these parts in particular simple manner should they become unreliable due to wear. The direction of rotation of the die carrier in operation is preferably selected in the sense that it causes the threads to be screwed into one another so that a particularly disturbance-free connection is possible between the die and the die carrier, since the die is prevented from becoming loose during its rotation.

When threads are provided on the die and on the die carrier then the simple rotary movement required to tighten the die carrier could be effected by hand, particularly bearing in mind that the die has a relatively large diameter so that the operator has a good mechanical advantage, or can also be carried out using the drive motor for the die carrier.

In this respect an embodiment is particularly preferred in which drive means is provided for driving said die carrier during operation of said pellet mill via a torque transmitting mechanism and wherein means is provided for effecting relative rotational movement of said die relative to said die carrier into the said second relative position via said torque transmission.

This relative rotational movement into the second relative position is conveniently produced by a drive means separate from the drive means for driving the die carrier with the separate drive means operating at a substantially slower speed and with switchable clutch means being provided for selecting between the first drive means and the second separate drive means. The second separate drive means can conveniently operate on the torque transmission via a reduction gear box.

Since the relative rotation between the die and the die carrier forms a measure of the clamping force that is exerted, a position transducer associated with the second drive means can be provided for switching on the second drive means to effect a predetermined angular rotation to produce the desired relative rotation or movement of the die carrier relative to the die, and to switch the second drive means off again at the end of said relative movement.

Although the clamping of the die in the die carrier is preferably effected via the centering means and the means for drawing the die into the die carrier it is also possible to use radially actuatable holding elements to effect clamping of the die in the die carrier.

By way of example the means for exerting a radially directed force on the die may comprise a membrane mounted within the annular recess of the die carrier with means being provided for applying fluid pressure to a side of the membrane remote from the die to deflect the membrane into engagement with the die. The membrane can either be a single annular membrane with an annular pressure chamber provided on the side of the membrane remote from the first end of the die, or could also take the form of a plurality of pad-like membranes which are uniformly distributed around the first end of the die with a separate fluid pressure chamber being provided in respect of each said membrane. The use of membranes also enables a clamped seating of the die to be achieved in a particularly simple manner with or without the presence of a form-locked connection. A sufficient force transfer is possible between the die carrier and the die even under the initially discussed unfavourable conditions (temperature and dimensional differences, walking work of the die and vibrations).

In any event the use of radially actuatable holding members, for example the membrane or membranes which can be pressed against the die, makes it possible to achieve a force transmitting connection between the die carrier and the die in a simple manner with dimensional changes being easily compensated for.

If at least one pressure accumulator is provided in the fluid line leading to the chamber or chambers behind the membrane then it is possible to achieve advantageous pressurization of the membrane even when a connection to the pressure generator, for example hydraulic pump or compressor, has been interrupted. In this way there is no need to provide a rotary connection for the supply of fluid pressure to the chamber or chambers behind the membrane during the operation of the pellet press.

Finally, it should be mentioned that the threads could be formed as conical threads so that the threads themselves already serve as an essentially conical fitted surface and take on the centering function. Particularly high forces can be transmitted via an arrangement of this kind. Such conical threads are for example used in survey conduits and pipelines in the oil industry.

The invention will be described in more detail in the following with reference to the drawing in which.

Figure 1:
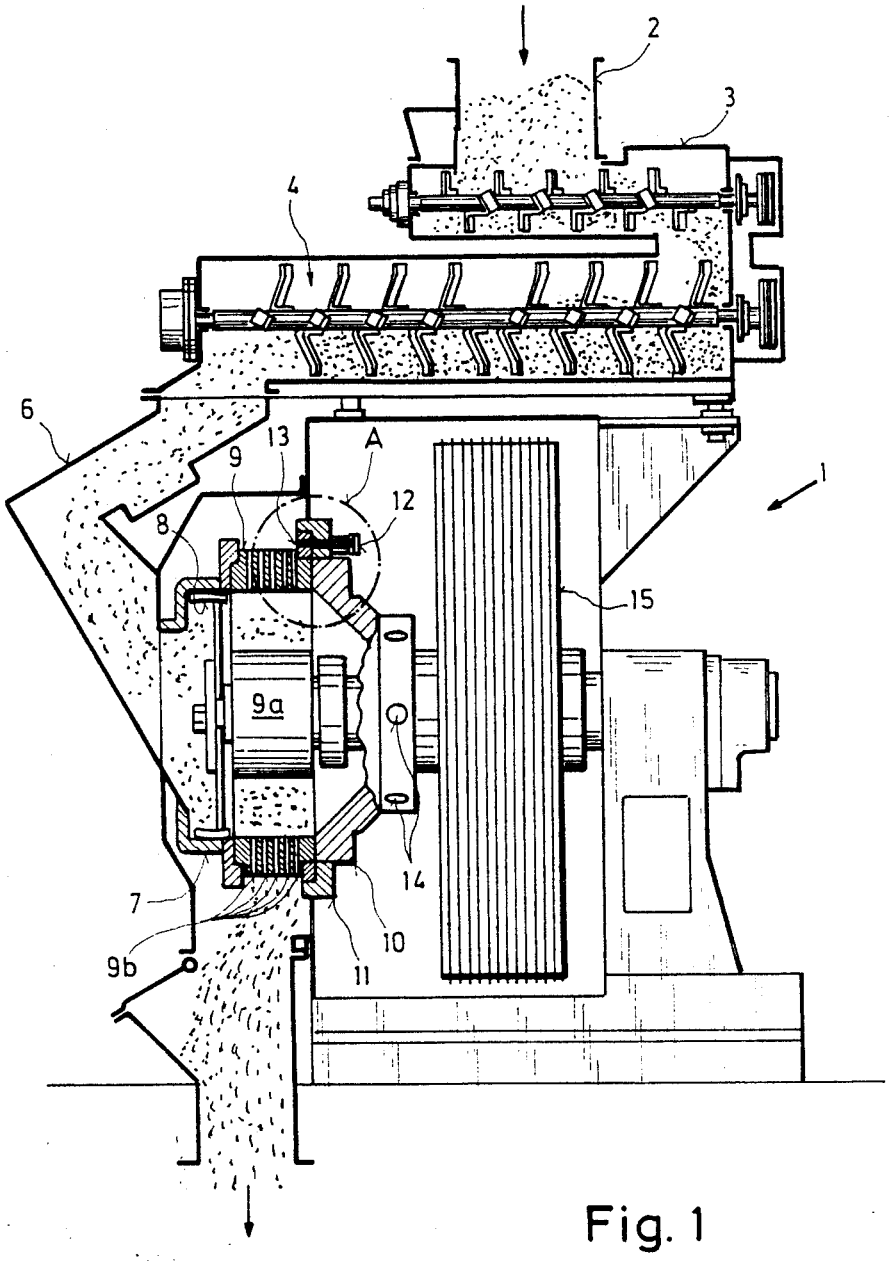
FIG. 1 shows a known pellet mill in an axial section with the joint region between the die and the die carrier being designated by the letter A.
Figure 9:
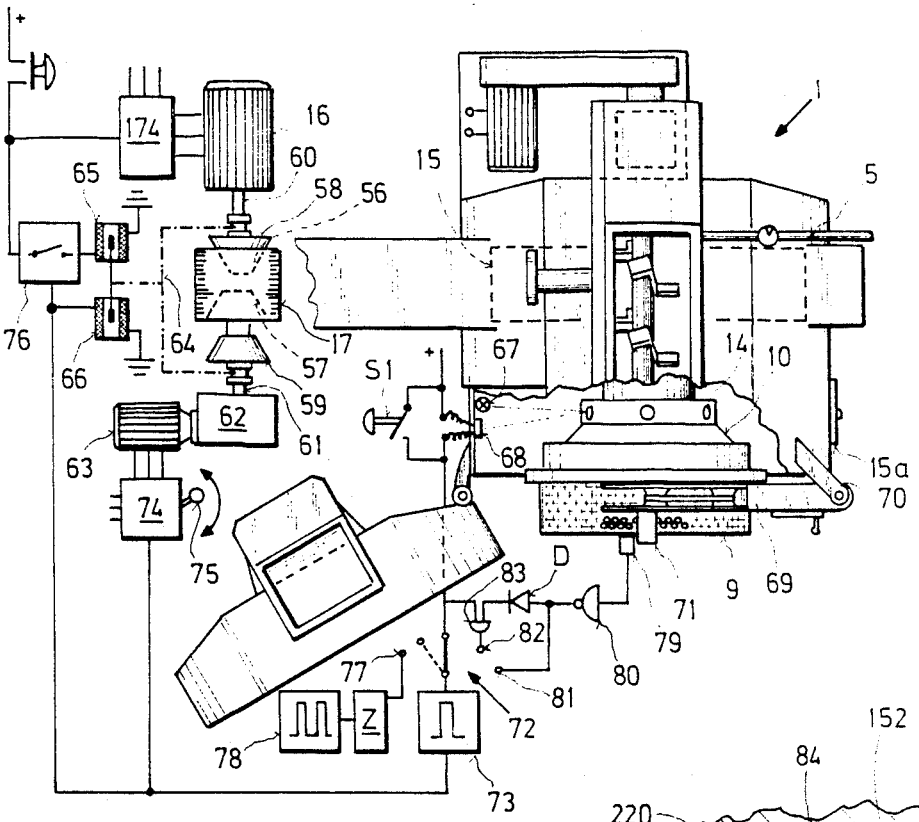
FIG. 9 shows the pellet mill in plan view with automatic program controlled attachment of the die to the die carrier.

As seen in FIG. 1 the material to be processed in a pellet mill 1 is supplied via a filling funnel 2 to a metering apparatus 3 which directs a predetermined quantity of this material per unit time to a mixer 4. Water vapour is simultaneously supplied to the mixer 4 via a steam line 5 (FIG. 9). The so mixed material then enters into a kinked channel 6 which feeds it to a die cover 7 from where it passes via scaper blades 8 into the interior of a matrix or die 9 and is there pressed through the radial bores **9*b* of this die with the aid of press rollers 9*a***, which roll against the inside surface of the die.

The matrix 9 is held in position in a customary embodiment with the aid of a ring 11 secured to a rotatable die carrier 10 and a clamping ring 13 which can be pulled by bolts 12 into a conical seat of the ring 11. The die carrier 10 is turned on further by hand for the tightening of the threaded bolts 12 by inserting levers into holes 14. The holes are accessible via a side door **15*a* (FIG. 9). The normal drive for the parts 9 to 14 takes place via a drive wheel 15 which is driven by means of V-belts from a main motor 16 (FIG. 9) via a V-belt pulley 17**. Naturally any other form of drive could also be selected in place of the V-belt drive shown here by way of example.

The present invention is based, as previously stated, on the object of simplifying and improving the arrangement in the region A of FIG. 1.

Figure 2:
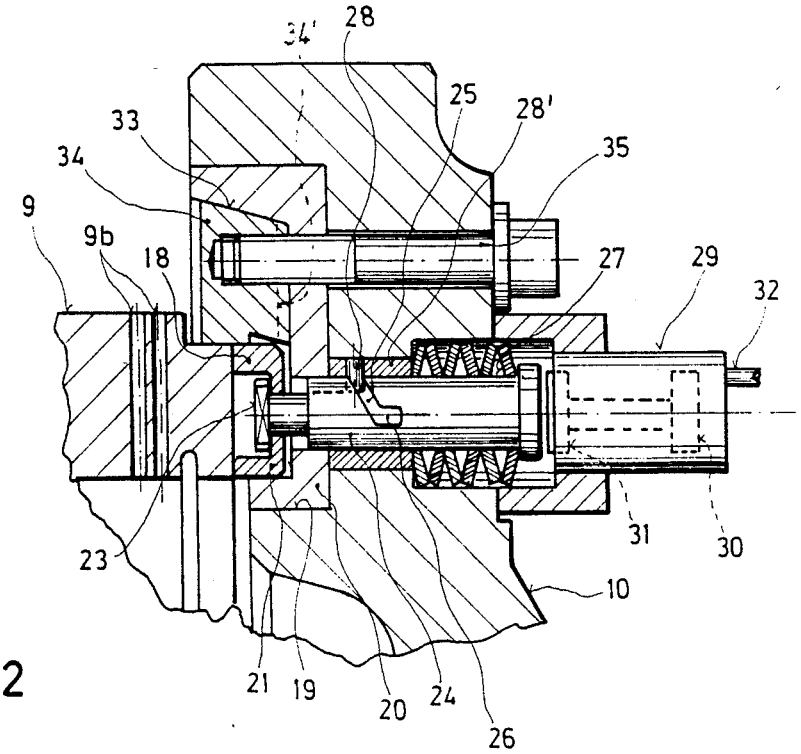
FIGS. 2 to 5 show the joint region A to a larger scale to illustrate embodiments in accordance with the invention.

The embodiment of FIG. 2 serves primarily to avoid the work and effort involved with a threaded arrangement. In the FIG. 2 embodiment the die 9 is centered on the die carrier 10 bearing means of the centering jaws 34, and is clamped by means of clamping jaws 35' (right hand edge indicated in broken lines). The jaws 34, 34' are of sectorial shape and are alternatingly arranged around the circumference of the end of the die received in the annular recess 19 of the die carrier.

In this embodiment the fixing means referred to earlier comprises a plurality of cup-like centering parts 18 which are provided at the end face of the die disposed around its periphery. In place of a plurality of such cups it is also possible to secure an annular ring 181 of approximately U-shaped cross-section (see FIGS. 3 and 7) to the die 9, for example by welding. The annular recess 19 of the die carrier 10 contains an insert 20 having a similar recess 21, with the annular ring 181 being insertable into the recess/21.

Figure 6:
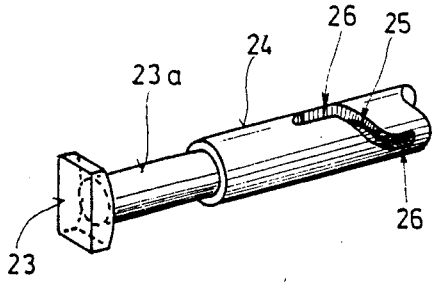
FIG. 6 is a perspective illustration of a locking bolt used in the embodiments of FIGS. 2 to 5 with FIG. 7 showing the arrangement of such locking bolts relative to the die in a partial end/view of the latter.
Figure 7:
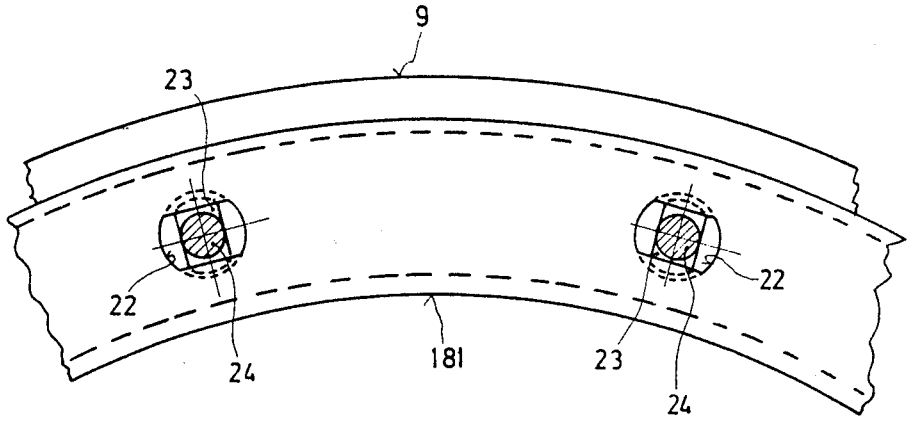

As FIG. 7 shows the annular ring 181 has radially extending elongate holes 22 which lie on a common pitch circle and are uniformly distributed around the rail 181. The elongate holes 22 are so laid out that heads 23 of pins 24 forming cooperating fixing means can enter into these elongate holes 22 in a first relative position. A suitable pin 24 is shown in section in FIG. 6. Its precise construction is evident from FIG. 6. The pin 24 has an approximately helically extending groove 25 of a pitch which is sufficiently large that this "thread" is in any event not self-locking. At each end of the threaded part which extends approximately over a quarter of the circumference of the pin 24 there is located an end part which extends parallel to the axis of the pin. The pin 24 is loaded towards the right hand side (related to FIG. 2) by plate springs 27 or the like. A projection or pin 28 secured to the die carrier 10 and which, for example, passes through a bearing sleeve 28 engages into the grooves 25, 26 of the pin 24. A displacement of the pin 24 in the axial direction must therefore necessarily bring about a rotation of the pin through 90° into a second position relative to the annular ring 181 (FIG. 3) or cups 18 (FIG. 2) in which the head 23 of the pin engages behind the lip of the corresponding aperture in the annular ring or cup. Moreover, the springs 27 generate a force which draws the die into the die carrier.

As seen in FIG. 2 a piston-in-cylinder unit 29 is arranged behind the cylindrical pin 24, with the piston 30 carrying a ram 31 at its left end. If a pressure medium is now applied to the piston 30 via the line 32 then the piston overcomes the force of the springs 27 and pushes the pin 24 to the left. In so doing the pin 24 will be rotated as a result of the threaded nut 25 through 90° so that its elongate head 23 is aligned with the opening 22. In this position the die 9 can be drawn away from the pins 24 or a new die can be pushed into place. As soon as a new die has been pushed into place the piston 30 is relieved whereupon the pin 24 again moves to the right (related to FIG. 2) under the loading of the plate springs 27 and as a result of the thread groove 25 moving into the locked position shown in FIG. 7. During this, the U-section ring rail 181 (or the cups 18) is (are) drawn into the cut-out 21 and this ensures a central seat of the die 9. After this it is only necessary to secure the die in this central position for which purpose the annular recess or cut-out 21 of FIG. 2 has an inclined surface 33 of its outer side into which the jaws 34' can be drawn with the aid of threaded bolts 35.

Figure 3:
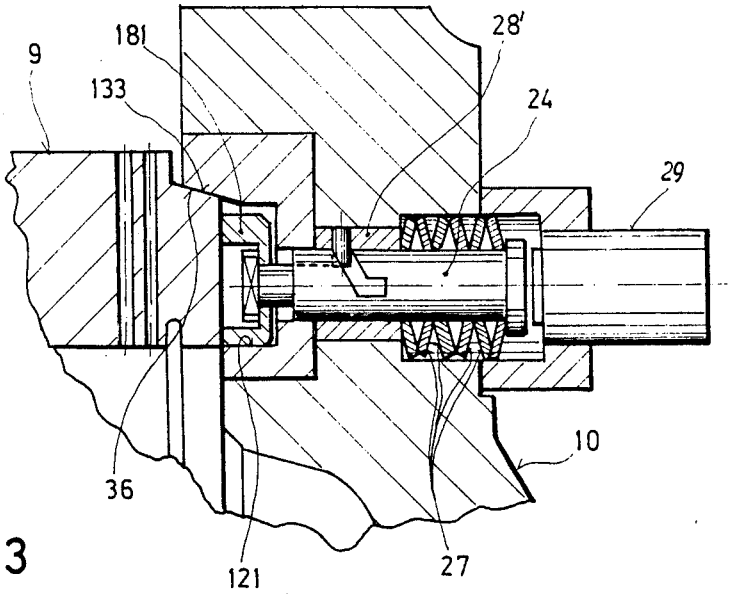

In the embodiment of FIG. 3 the threaded bolts 35 and the jaws 34' can be eliminated when the cut-out 121 is provided with an outer conical (inclined) surface 133 lying within a somewhat smaller diameter, with the conical surface 133 cooperating with a corresponding conical surface 36 of the die 9. In this case the springs 27 must be so laid out that the die 9 is secured in a frictionally locked engagement at the inclined surface 133, with a form-locked connection being obtained via the pins 24 and the U-section ring rail 181.

Figure 4:
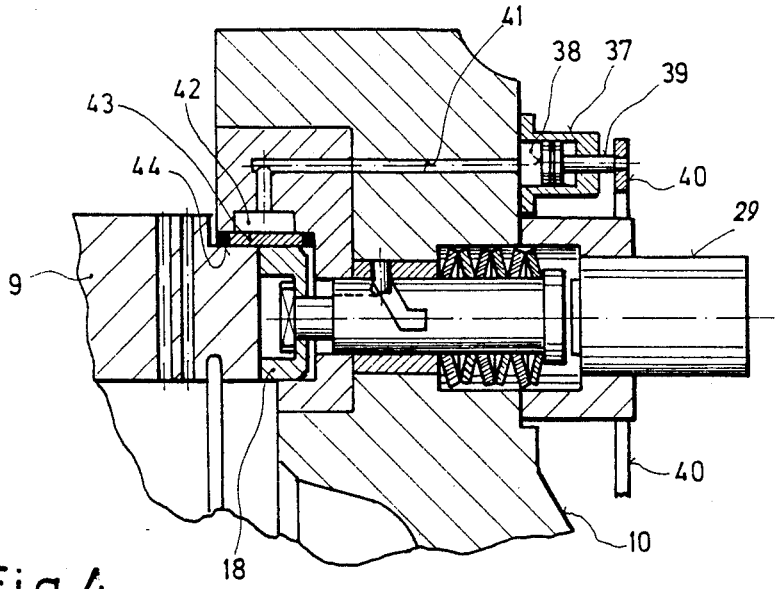
Figure 5:
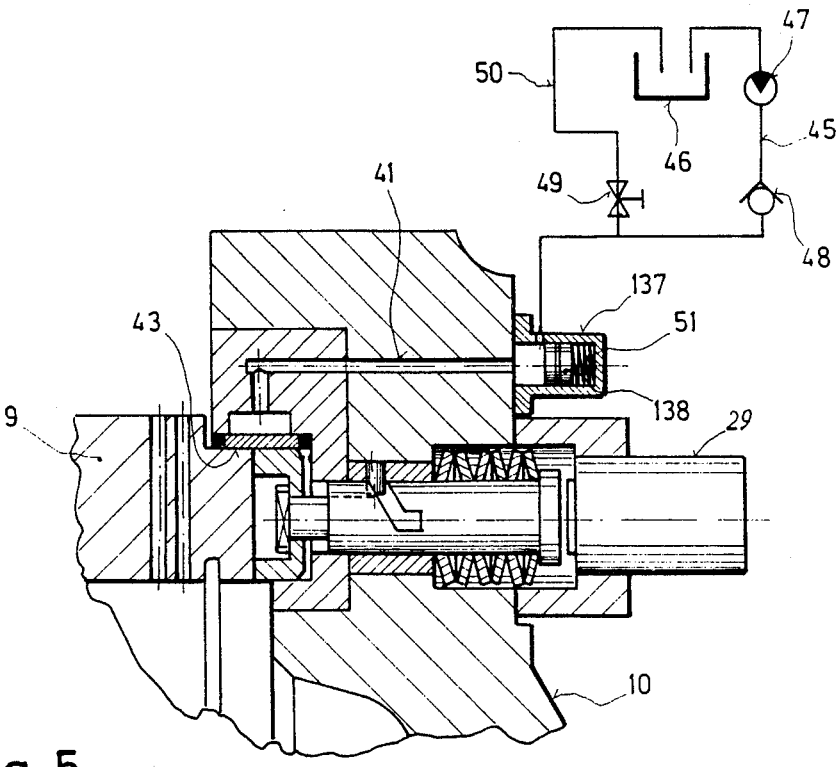

FIGS. 4 and 5 show an embodiment in which a clamped attachment is achieved with the aid of a pressure medium in place of the bolts 35 of FIG. 2, with the drawing of the die 9 into the die carrier 10 being carried out in just the same manner as in FIGS. 2 and 3.

In the case of FIG. 4 at least one pressure unit 37, optionally however a number of such pressure units is provided at the rear side of the die carrier 10. In the case of a plurality of pressure units the latter are distributed around the periphery of the die carrier. Each of the pressure units 37 has a piston 38, the rod of which projects rearwardly and is actuatable in any desired, non-illustrated manner via a ring plate 40 connected to these piston rods 39. By way of example the ring plate 40 could be moved to the left or to the right (related to FIG. 4) via threaded elements. Alternatively the piston rod 39 could also be replaced by a bolt and could for example be actuated in the manner which is later described with reference to FIG. 16A.

A pressure medium, preferably hydraulic fluid, is accommodated in the line system 41 on the left hand side of the piston 38. This line system opens at the side of the die 9 into a chamber 42 which is closed by a membrane 43, for example of sheet metal. If the piston 38 is moved to the left—related to FIG. 4—then the membrane 43 expands and presses against the U-shaped ring rail 181 and against a ring shoulder 44 of the die 9. The die expediently has a corresponding recess (non-illustrated) into which the membrane (or a piston) can enter.

Although FIG. 4 illustrates a ring membrane 43, it will be appreciated that the ring membrane could be replaced by a plurality of pad-like membranes or pistons and that the sectional illustration of FIG. 4 would also apply to such an embodiment.

Whereas in the embodiment of FIG. 4 a certain amount of mechanical work is necessary to adjust the ring plate 40 the work can be further simplified by the embodiment of FIG. 5. Here the hydraulic actuating units 37 (FIG. 4) are replaced by similar units 137 which have however the function of a pressure store or buffer. A line 45 can in this case be supplied from a pressure medium reservoir 46 with the aid of a pump 47 which feeds into the unit 137 and the line system 41 via a non-return valve 48. If the membrane 43 is however to be relieved then it is merely necessary to open a valve 49 in a branch line 50 whereupon the pressure medium flows again into the reservoir 46. In this arrangement the piston 138 of the unit 137 is expediently loaded by a spring 51 (it can also be a gas spring) which balances out any pressure peaks which may occur. Pressure sensors can be attached for monitoring purposes and can for example initiate an alarm if the pressure falls short of a desired value.

It will be understood that the pin 24 which acts as the fixing holding member actuatable in the axial direction can be modified in various manners. By way of example the pin itself can carry the projection 28 whereas the groove 26 can be machined into the guide sleeve 28', i.e. into the guide sleeve which carries the pin 28 in FIGS. 2 and 3. With reference to FIG. 6 one can easily imagine that the pin is formed in two parts with the front part **23*a* of reduced diameter being the piston rod of a fluid loaded piston displaceable in a cylinder 24. In this case the piston rod 23*a* can carry the guide projection corresponding to the pin 28 and can be rotatable by a groove 26 formed in the cylinder 24, so that a further unit 29** is then no longer necessary.

In just the same way it is understandable that it can be advantageous to provide springs 51 or a gas cushion (as is usual in pressure accumulators) in the unit 37 of FIG. 4. In so doing the connection for the line system 45 to 50 at the cylinder 37 or 137 respectively may have an additional valve (not shown) in order to be able to close the respective unit after supplying the pressure medium. However the valves 48 or 49 can be directly mounted on the unit 37 or 137 so that a coupling connection exists for the lines 45 and 50. In this case the non-return valve 48 could be provided at the cylinder 137 and the latter could have a coupling for the selective connection of, for example, a branch connection of for example a pressure line, in which the valve 49 and the pump 47 is provided (for example in a parallel branch).

Figure 8:
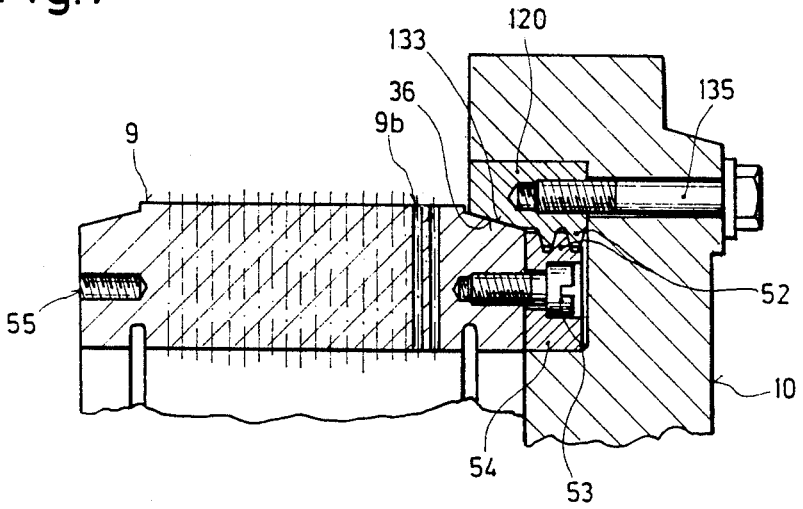
FIG. 8 shows a preferred embodiment of the detail A of FIG. 1 in an enlarged representation similar to the FIGS. 2 to 5.

In the preferred embodiment shown in FIG. 8 the die 9 has a conical wedge surface 36 similar to the embodiment of FIG. 3. As in the case of FIG. 3 this conical wedge surface 36 faces, i.e. is opposite to, a conical surface 133 on an insert 120 at the die carrier side 10. It will be understood that instead of using an insert 120 the annular recess in the die carrier 10 could itself have the inclined surface 133, however the use of an insert 120 is preferred since in this case it is easier to exchange the insert if wear should take place. In any event the ring insert 120 is fixedly screwed to the die carrier 10 with the aid of bolts 135. It should be pointed out that these bolts 135 do not normally need to be released during die change.

The insert 120 is characterised in that it is equipped with a thread 52, preferably a multiple start thread. In the same way the die 9 has a threaded ring 54 which is fixedly screwed thereto with the aid of screws 53. For this purpose the die 9 is provided with corresponding threaded bores 55 at both end faces.

During a die change it is thus only necessary to screw the threaded ring 54 of the die into the thread 52 whereupon the surfaces 36, 133 ensure a firm seat. It will in other respects also be understood here that the threaded ring 54 could optionally be part of the die 9.

Thus the cooperating screw threads on the threaded ring 54 and on the thread 52 form fixing means and cooperating fixing means which can be inserted into each other in a first relative position and can be rotated relative to each other into a second, force transmitting, relative position. The pitch of the cooperating screw threads generates a force which draws the die into the die carrier.

The two threads 52, 54 are formed to be self-locking. Furthermore it should be mentioned that the securing holes 55 are arranged approximately at the center of the thickness of the die ring 9 since there the stresses are lowest in operation. Moreover, the symmetrical construction with bores 55 at the two end faces also has the advantage that a reinforcement ring which is normally provided at the front side and fixedly screwed to the threaded bores remote from the die carrier 10 is in the same threaded holes 55.

The thread is expediently so constructed that it is turned in the normal direction of rotation of the die carrier 10 in the sense of being screwed in, and it may pull itself in too tightly in the course of operation, so that the releasing of this threaded connection can be made more difficult. Various embodiments for simplifying the rotational tightening via a thread or for releasing the same with the aid of servo-actuating means will now be discussed in the following with reference to FIGS. 9 to 16A. That is to say devices will now be discussed which make it possible to achieve relative rotation of the threaded parts with the minimal expenditure of force even when the latter have seized solid.

With reference to FIG. 9 it is shown how the drive which is present per se for the pellet press 1 can be exploited in the case of a threaded connection of the die and die carrier. The V-belt pulley 17 which has already been mentioned has for this purpose two conical coupling recesses 56, 57 in its interior with a respective coupling cone 58, 59 being disposed opposite to each of these coupling recesses. Whereas the cone 58 is axially displaceable on the shaft 60 of the main motor 16 and is rotationally fixedly connected to this shaft, the cone 59 sits on an output shaft 61 of a reduction gear box 62 which receives its drive from an auxiliary motor 63. The cone 59 is also rotationally fixedly connected with its shaft 61 but is also axially displaceable thereon. Both cones 58, 59 are adjustable by a common actuating means 64 so that in each case only one of the two cones 58, 59 can be coupled with the V-belt pulley 17. By way of example two moving coil magnets 65, 66 can serve as a displacement drive.

With the aid of the reduction gearing 62 a pronounced reduction with at least one order of magnitude and preferably two can be obtained with the speed ratio being for example at about 1:200. It is also conceivable that a speed difference of this kind could be achieved by purely electrical means, for example by using additional windings or by using a DC motor with corresponding control for at least two speeds or the like. It will however be understood that the insertion of a reduction gearbox 62 is constructionally the simpler route. In so doing it would also be possible to lay out the reduction gearing 62 so that it is selectively drivable by the motor 16 so that the motor 63 would be unnecessary. This would however lead to greater cost with respect to the transmission than would be saved thereby, which is why the auxiliary motor 63 is the preferred arrangement.

It should be mentioned that the problem of providing a main drive and additionally thereto also a slow drive (and that is what we are concerned with here) also exists with cineprojectors where it is namely necessary to achieve a normal speed or a slow speed (for search or individual picture selection). In such cineprojectors reduction transmissions are also used, however with a drive via a single main motor, and these known solutions could also be used for the present purpose. In similar manner to that in which the vane diaphragm of the projector is driven at a periphery via the reduction transmission, a periphery of the die carrier could also have a drive surface, for example a toothed ring, for the engagement of a reduction transmission gear.

The thread 52, 54 (FIG. 8) is now preferably so constructed that a rotation between 15° and 100° is sufficient to pull the die 9 tightly onto its carrier 10. Accordingly, after the motor 63 is switched on, in order to turn the die carrier 10 at a reduced speed, it is advantageous for automatic switch-off to take place as soon as the die 9 has been secured to the carrier 10. This is solved in various ways in the diagram of FIG. 9.

One possibility is to provide a light source 67 for illuminating the outer periphery of the die carrier 10. The arrangement is such that the light beam is incident on that region in which the holes 14 are provided, so that the latter then simultaneously serve as markings. It will be understood that any other form of marking could naturally likewise be provided. When the light beam now falls on the outer periphery of the die carrier then it will be reflected towards a photocell 68. If however a hole 14 is present then no reflection will result. This signifies that the output signal of the photocell 68 is interrupted at each hole 14.

At the pellet mill 1 a block-and-tackle 69 is pivotally mounted about an axle 70 and carries the die 9 on a hook 71 at the right level for the mounting of the same. When the die carrier 10 has now been inserted so that the light beam of the light source 67 is directly directed towards a hole 14 then the motor 63 cannot be excited even when a selection switch 72 is moved out of the broken line position into the position shown with full lines. This selection switch 72 lies in the supply circuit of a pulse shaping stage 73 to which a stage 74 is connected. The auxiliary motor 63 is not only supplied with power via the stage 74 it is also possible to select the direction of the rotation with the aid of the switch 75. The line coming from the pulse shaper 73 thus forms the control line for the feed stage 74. The rotation reversing means 75 can naturally also be purely mechanically constructed, for example as a reversing drive.

If one now wishes to set the motor 63 in operation then it is sufficient to close the switch S1 briefly, whereby the photocell 68 is bridged until it again receives reflected light from the outer surface of the die carrier 10. The time constant of the pulse shaper 73 should be correspondingly dimensioned. At the same time the magnet pair 65, 66 is energised to such a degree that the cone 59 enters into the recess 57 whereas the cone 58 is decoupled. An interrupter 76 can be provided so that the magnet 65 is not energised in error. This interrupter 76 lies parallel to a control line for controlling a stage 174 for the motor 176 which is similar to the stage 74. Thus, as soon as the motor 63 drives the die carrier 14 slowly the threaded rings 52, 54 (see FIG. 8) are screwed into one another with the current being interrupted via the output signal of the photocells 68 when the next hole 14 appears at the outer periphery of the die carrier 10. The selection switch 72 can also be connected to a terminal 77 which lies at the output of the counter Z. In this case the control takes place independently of time, i.e. a switching-off signal is achieved via the pulse shaping stage 73 as soon as the counter Z has received a predetermined number of pulses from a pulse generator 78.

Since it would be conceivable that the die 9 is not set at the right level in the right position with the aid of the block-and-tackle 69, which could lead to jamming of the thread, provision is made for recognising this state of affairs. This is done by noting the appearance of forces acting on the hook 71. Accordingly, it may be expedient to mount a strain gauge 79 there (or an extension or compression measuring device which presses against the hook 71 as a result of the torque) with the relevant device transmitting an output signal which is inverted via an inverter 80. I.e. on the occurrence of an unusual voltage at the strain gauge 79 the output signal of the inverter 80 is interrupted. Thus, if the selection switch 72 is connected to a terminal 81, the operation of the motor 63 is then either interrupted when a fault occurs in the positioning of the die, or when the die 9 is fixedly screwed to the die carrier 10, in which case the torque likewise rises at the die 9 and thus at the hook 71.

It is also straightforwardly possible to use the strain gauge, for the recognition of faulty positioning, and to allowing the photocell 68 to work at the same time. For this purpose the selection switch 72 can be set to the terminal 82 which is decoupled from the terminal 81 via a valve circuit (diode D) so that the photocell terminal 81 is inactive. Since the terminal 82 is controlled via a gate circuit 83 the motor 63 can only run when the photocell 68 transmits a signal and the strain gauge 79 remains free of disturbance.

A simplified circuit could also be so constructed that the motor 63 is simply switched on and off manually in each case via the touch switch S1. In this case the further parts 67 to 73 of the circuit shown in FIG. 9 can be spared.

Irrespective of how the circuit is laid out it is also preferred to provide a corresponding counter Z, 68 or 69 by means of which the end of the screwing process is indicated. It will be understood that by reversing the lever 75 the direction of the motor 63 is reversed so that in this way the die 9 can also be released from the die carrier 10 with the aid of engine power.

Figure 10:
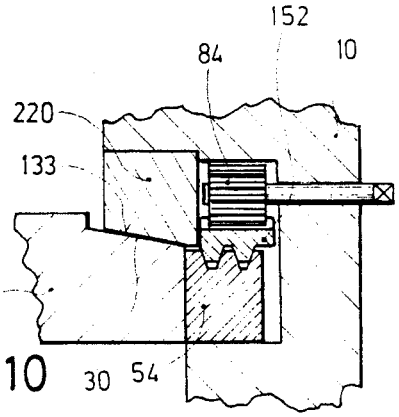
FIGS. 10 to 12 show various means for simplified rotation of the thread.
Figure 11:
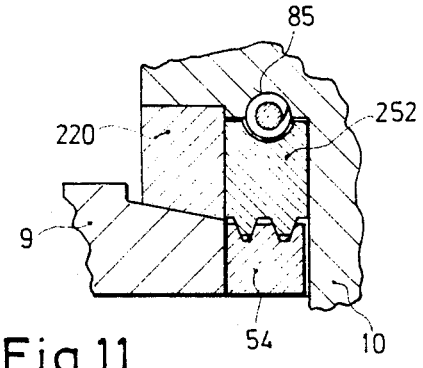
Figure 12:
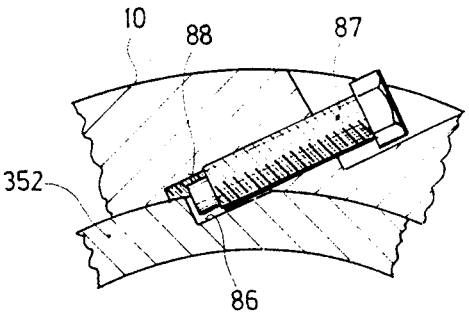

If however, one wishes to make use of simpler means then the embodiments of FIGS. 10 to 12 can be considered. In the case of FIG. 10 an insert ring 220 is provided which has a conical surface 133. The insert ring 220 is fixedly secured within an annular recess in the die carrier, e.g. by means of radially extending screw threaded fasteners (not shown). In addition a threaded ring 152 separate from this insert ring 220 is provided in the annular space formed between the ring 220 and the die carrier 10. The threaded ring 152 has a toothed ring at its outer side in which a toothed pinion 84 engages. Thus in operation the die can readily be screwed into the die carrier by cooperation between the threaded ring 54 and the threaded ring 152 which is held stationary via the pinion, indeed friction alone may be sufficient. During this screwing movement the die is drawn into the die carrier so that the conical surfaces on the die 9 and on the ring 220 come into engagement with each other firmly locking the die to the die carrier. To release the threaded connection it is possible to drive the toothed pinion 84 at the rear of the die carrier 10 by means of a socket spanner or the like.

The solution of FIG. 11 is similar, however the threaded ring 252 has worm gearing at its outer side into which a worm gear 85 engages approximately tangentially with the worm gear 85 having a connection for a socket spanner at the outer side of the die carrier 10. This arrangement has the advantage that the worm and worm wheel arrangement is non-reversible, i.e. the worm does not need to be held during mounting of the die, nevertheless a high mechanical advantage is available on releasing the die by turning the worm 85 rotating the ring 252. Moreover, worm 85 is readily accessible through a side door of the mill housing.

The construction of FIG. 12 is even simpler in which an outer threaded ring 352 has a notch recess 86 at its rear to the outer side. A screw 87 which is directed approximately tangentially at the outer periphery of the die carrier 10 projects into this notch recess and the threaded ring 352 is rotated in the counter-clockwise sense on rotating the screw within a threaded recess 88. Here a positive stop exists which holds the ring 352 during insertion of the die into the die carrier and during rotation thereof to produce engagement of the threaded ring 54 of the die with the threaded ring 352 and engagement of the conical surfaces on the die 9 and insert 220. Only a small rotational movement of the ring 352 need be induced by the bolt 87 in order to loosen the threaded connection between the ring 54 and the ring 352 and produce abutment of the ring 352 against the die carrier whereupon the threaded connection pushes the die 9 axially away from the die carrier 10 breaking the engagement of the conical surfaces. This also applies to the FIGS. 10 and 11 embodiments.

It is thus evident that it is advantageous to provide at least one actuating or drive means for the threaded connection with this drive means being arranged at least in the sense of releasing the threaded connection and preferably also the engagement between the conical surfaces.

Figure 13:
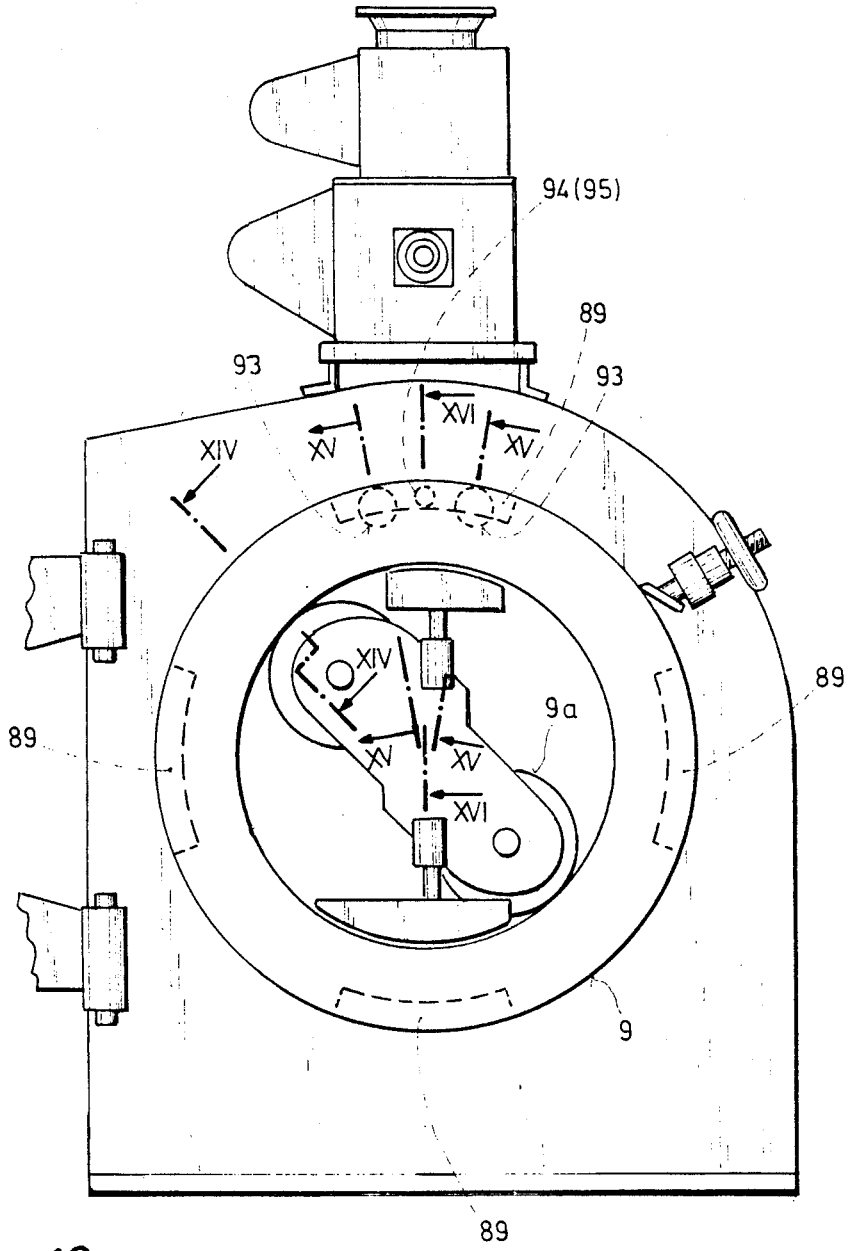
FIG. 13 shows a pellet mill in a front elevation.

A pellet mill is shown in FIG. 13 in a view from the front with the die carrier 10 having threaded sectors 89 situated at an angular spacing from one another. The die 9 has however in contrast preferably an uninterrupted threaded ring, although the reverse arrangement (die with threaded sectors and die carrier with a full thread) or an arrangement in which the die 9 also has threaded sectors would also be conceivable so that the die does not have to be screwed into the die carrier but merely needs to be inserted with the threaded sectors displaced and then rotated by approximately the arcuate extent of the threaded sectors. Such closures are for example known in the artillery field and have proved themselves there particularly with regard to their high robustness and loadability. In any event temperature and vibrational loadings also arise with artillery locks (shell chamber closures).

Figure 14:
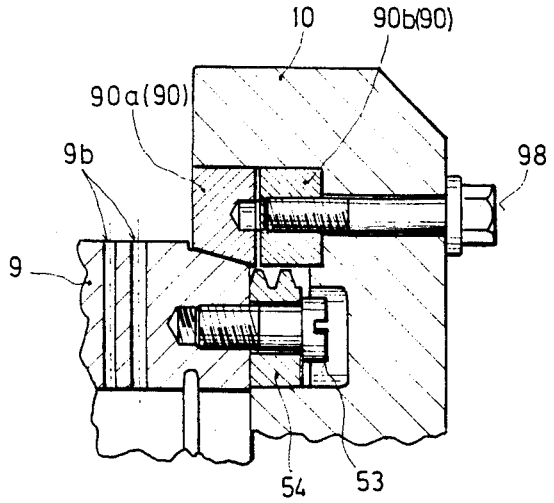
FIG. 14 is a section on the line XIV—XIV of FIG. 13.

As seen in FIG. 14 the die 9 has a threaded ring 54 which is expediently connected with the die 9 by screws 53 although it could also be formed in one piece therewith. The die carrier 10 has for example a ring 90 which is provided with the threaded segments 89 which have been inserted into recesses in the ring 90 or in the die carrier 10. The ring 90 can optionally also be made in several pieces, and indeed, both in the circumferential direction—with threadless sections **90*b* being provided between the threaded sectors 89—and also in the axial direction, with an outer part 90*a* having a conical mating surface which cooperates with the conical mating surface of the die 9. Thus the sections 90*b* can be secured with special set screws 98 (FIG. 14), and the segments 89 (FIG. 15) with set screws 91** which are described below.

If, as in the case of FIG. 13, four different threaded sectors 89 are displaced around the periphery of the die carrier 10 then it is favourable for the associated thread to be a four-start thread so that with an appropriate thread height it is easy to arrange for one thread of the ring 54 to engage into the thread of the sectors 89 without these having to be arranged axially displaced. Thus in this way one saves constructional length in the axial direction. If a different number of sectors 89 is selected then it is again favourable to match the number of thread starts to the number of sectors.

Figure 15:
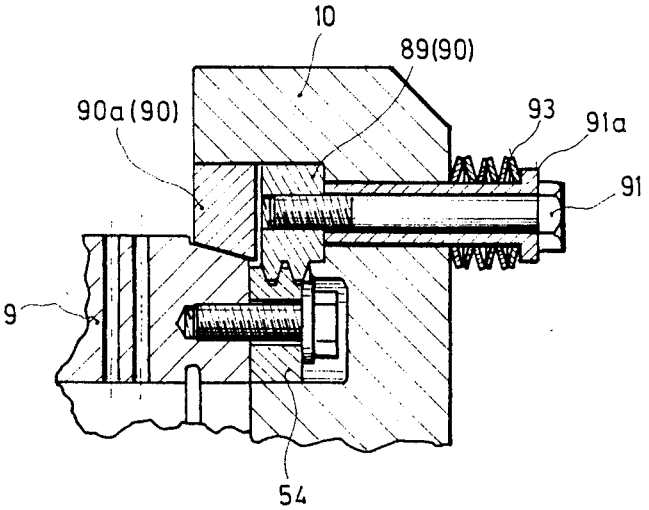
FIG. 15 is a section on the line XV—XV of FIG. 13.

FIG. 15 shows the section through a portion of the multi-part ring 90 with a threaded segment 89, with the threaded segment 89 being retained via bolts 91, a sleeve **91*a* and plate springs 93. The plate springs enable a resilient displacement of the threaded segment 89 parallel to the axis of the die carrier 10 when it is either fluid-loaded via a piston-in-cylinder unit 95 (FIG. 16) with the aid of a pusher 94 or via a screw 96 (FIG. 16A) which will later be described in detail. As a result of an axial movement of this kind the right hand flank of the thread is relieved at the segments 89 which can seize fast at the oppositely disposed left hand flanks of the threaded ring 54 as a result of the temperature effects and vibrations which occur in operation and also as a result of the rotation of the die carrier 10** which expediently takes place in a direction which, having regard to the trend of the screw threads would produce screwing in of the die into the die carrier, i.e. a tightening of the threaded engagement and of the engagement between the conical surfaces. If these flanks are now lifted away from one another the screwing out of the die is again simplified with the die simultaneously being released from its conical seat.

Figure 15A:
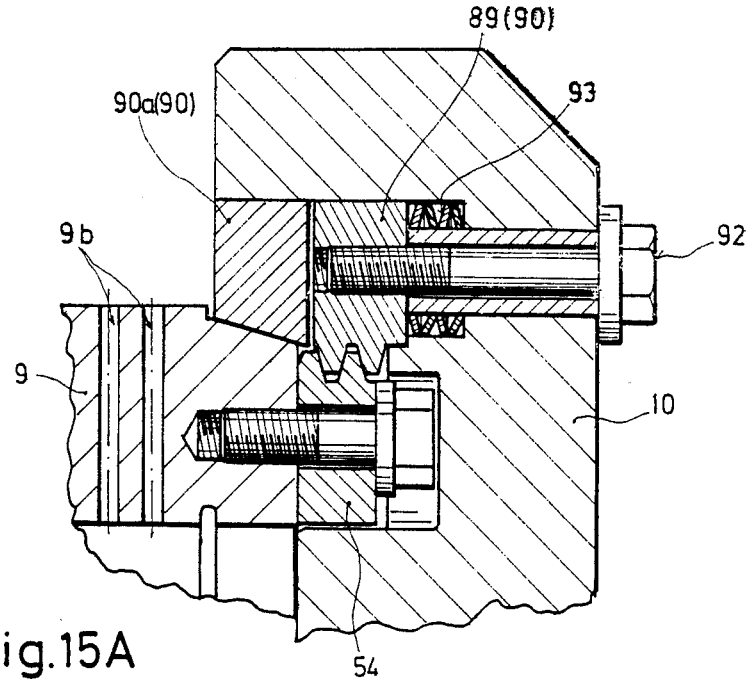
FIG. 15A is a variant of FIG. 15.

The plate springs 93 do not necessarily have to be arranged at the outside of the die carrier as shown in FIG. 15. Instead they can be positioned in accordance with FIG. 15A and serve for direct springing of the threaded segments 89. However, in the case of FIG. 15 the springs 93 act in the sense of positioning the threaded segments in the direction towards the pressure unit 95. In the case of FIG. 15A the springs tend to release the segments (on loosening of the bolts 92).

Figure 16:
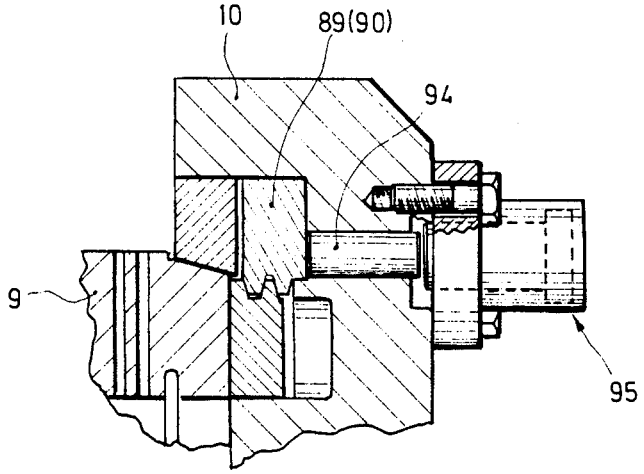
FIG. 16 shows a section on the line XVI—XVI of FIG. 13.

The pressure unit 95 shown in FIG. 16 is arranged in accordance with FIG. 13 between two plate spring packs 93 and is expediently of similar construction to the unit 29 shown in FIG. 5. Above all it will expediently not be continuously connected with a pressure source but will instead only be connected in the stationary state of the die carrier with such a pressure source to release the die 9.

Figure 16A:
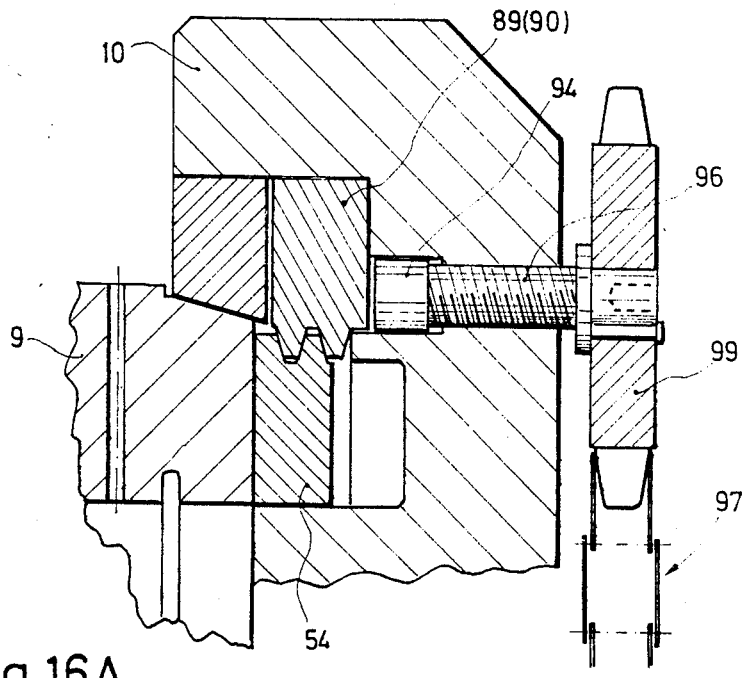
FIG. 16A illustrates a variant of FIG. 16.

In the embodiment of FIG. 16A the threaded segment 89 is moved via pushers 94 in similar manner to that of FIG. 16. In principle a single pusher 95 or 96 is sufficient, however if several pressure units are distributed around the periphery of the die carrier 10 then several pressure spindles 96 can be actuated jointly by chain 97 and chain sprockets 99. In analogous manner several fluid pressure units 95 can also be connected together via fluid lines.

In connection with the different constructional solutions it must be pointed out that with the mechanically actuated embodiments the changes in dimension due to heat can cause different movements. Hydraulic pressure members with storage springs 51 (FIG. 5) are however able to compensate for these dimensional changes, with the nature of the spring being immaterial (for example gas springs can also be used).

It will be understood that the resilient attachment in the axial direction of the thread or of the threaded segment 89 to the die carrier 10 can also be realised without a pressure unit 95 or 96, in which case the pusher 94 can for example be actuated by hand, as it were by means of a corresponding tool (see FIG. 15A).

In principle an analogous effect could naturally also be achieved by a resilient mounting of the threaded ring 54 of the die 9, however the elastic displacement in the axial direction will mainly be more difficult to bring about there, which is why the elastic attachment of the carrier side thread alone is preferred.

In the context of the invention it is straightforwardly possible to interchange individual ones or several of the described features with one another, to use them in different combinations with one another or with features of the prior art or on their own. The latter comment applies not only to the features mentioned in claim 1 but also to the described layouts of the slow drive for the pelleting press, which are also of importance in their own right independently of the pressure sensors 79 for checking the seat of the die on the die carrier. Such sensors could also be used in the case of the embodiments of FIGS. 10 and 11.

Particularly simple and rapid mounting of the die on the die carrier can be achieved when the clamped and centered position is reached after a relative rotation between the threaded parts around the axis of the die carrier in the range from 15° to 100°.

We claim:

1. A pellet mill comprising a perforated annular pellet die having an axis of rotation and first and second ends;

a die carrier rotatable about an axis of rotation coincident with the axis of rotation of said pellet die, said die carrier having an annular recess for receiving said first end of said annular pellet die;

first fixing means secured to said first end of said die and including a peripheral end surface of the die;

releasable fixing means provided in said annular recess in said die carrier, said first fixing means and said releasable fixing means having a first position relative to one another permitting insertion o f said first end into said annular recess by relative axial movement of said die toward said die carrier, and a second relative position of engagement of said first fixing means with said releasable fixing means permitting the transmission of force between said first fixing means and said releasable fixing means;

means for generating said force to draw said die towards said die carrier into said recess; centering means operative during a drawing of said die towards said die carrier to center said die relative to said die carrier;

means for releasing said die from said die carrier; and wherein said releasable fixing means include holding means on said annular recess of said die carrier, said holding means being radially movable from a retracted position into an advanced position in which said holding means radially protrude from said annular recess to engage said peripheral end surface of said die, and fluidic actuating means for moving said holding means into at least one of positions of said holding means.

2. A pellet mill in accordance with claim 1, wherein further fixing means is provided at said second end of said pellet die for cooperation with said releasable fixing means, thereby permitting attachment of said die to said die carrier at said second end.

3. A pellet mill in accordance with claim 1, wherein said first fixing means is provided at an end face of said first end of said die.

4. A pellet mill in accordance with claim 1, wherein said centering means comprises a first cylindrical surface provided in said recess, said die having a second cylindrical surface complementary to said first cylindrical surface and being a part of said peripheral surface provided at said first end of said die, said second cylindrical surface having substantially the same diameter as said first cylindrical surface.

5. A pellet mill in accordance with claim 1, wherein said holding means comprises a membrane mounted within said annular recess, and said fluidic actuating means are for applying fluid pressure to a side of said membrane remote from said die to deflect said membrane into said advanced position and into engagement with said peripheral surface of said die.

6. A pellet mill in accordance with claim 5, wherein said membrane comprises an annular membrane, there being an annular pressure chamber provided on the side of said membrane remote from said first end of said die.

7. A pellet mill in accordance with claim 5, wherein said membrane comprises a plurality of pad-like membranes uniformly distributed around said annular recess of said die carrier, there being a separate fluid pressure chamber provided in respect of each of said pad-like membranes.

8. A pellet mill in accordance with claim 5, wherein said fluidic actuating means for applying fluid pressure to said membrane comprises a fluid pressure pump.

9. A pellet mill in accordance with claim 5, wherein said fluidic actuating means for applying fluid pressure to said membrane comprises a piston and cylinder unit, said piston and cylinder unit being mounted on said die carrier; and means for driving said piston and cylinder unit to displace said piston within said cylinder.

10. A pellet mill in accordance with claim 7, wherein said fluidic actuating means for applying fluid pressure to said membrane comprises a piston and cylinder unit for each said membrane, said piston and cylinder units being mounted on said die carrier; and means for driving said piston and cylinder units for displacing pistons simultaneously within their respective piston and cylinder units.

11. A pellet mill in accordance with claim 1, wherein said first fixing means and said releasable fixing means are positively interengaged, at least in said second relative position;

said mill further comprises spring means located on said die carrier for urging said releasable fixing means against said first fixing means for increasing positive engagement between both of said fixing means; and hydraulic means for releasing said positive engagement.

12. A pellet mill comprising:

a perforated annular pellet die having an axis of rotation and first and second ends;

a die carrier rotatable about an axis of rotation coincident with the axis of rotation of said pellet die, said die carrier having an annular recess for receiving said first end of said annular pellet die;

first fixing means secured to said first end of said die and including a peripheral end surface of the die;

releasable fixing means provided in said annular recess in said die carrier, said first fixing means and said releasable fixing means having a first position relative to one another permitting insertion of said first end into said annular recess by relative axial movement of said die toward said die carrier, and a second relative position of engagement of said first fixing means with said releasable fixing means permitting the transmission of force between said first fixing means and said releasable fixing means;

means for generating said force to draw said die towards said die carrier into said recess;

centering means operative during a drawing of said die towards said die carrier to center said die relative to said die carrier;

means for releasing said die from said die carrier; and wherein said first fixing means comprises a plurality of undercut apertures provided in an end face of said first end of said annular pellet die; and wherein said releasable fixing means comprises a plurality of pins fixedly held by said die carrier and disposed parallel to said axis of rotation of said pellet die and having heads engageable in said first position within said apertures, and means for rotating said pins for engaging said heads behind said apertures in said second relative position.

13. A pellet mill in accordance with claim 12, wherein said apertures comprises apertures in the bases of beaker-like members, said beaker-like members having rims secured to said first end of said die, said apertures being uniformly distributed around said first end of said die.

14. A pellet mill in accordance with claim 12, wherein said apertures are formed in a base portion of an annular member of U-shaped cross-section.

15. A pellet mill in accordance with claim 12, wherein said means for generating said force comprises spring means acting between said die carrier and said pins to draw said die into a clamped position.

16. A pellet mill in accordance with claim 15, wherein said releasable fixing means comprises cooperating inclined slot means disposed on each of said pins for rotating said pins into said second relative position upon a drawing of said die towards said die carrier.

17. A pellet mill accordance with claim 12, wherein said centering means comprises a hollow conical surface provided in said annular recess; a plurality of centering segments, each centering segment having a conical surface at a radially outer side of the centering segment and a radially inner surface engageable with a complementary centering surface at said first end of said die; and means for moving said centering segments relative to said annular recess to produce centering engagement of said radially inner surfaces with said centering surface of said die.

18. A pellet mill in accordance with claim 12, wherein said annular recess has a hollow conical surface, there being a complementary conical surface at said first end of said die engageable with said conical surface to produce centering of said die relative to said die carrier during the drawing of said die towards said die carrier.

19. A pellet mill in accordance with claim 13, wherein said means for releasing said die from said die carrier comprises ram means for displacing said pins towards said die, there being spring means exerting a spring force on said pins in a direction for securing the die to the die carrier.

20. A pellet mill in accordance with claim 19, wherein said ram means comprises a fluid pressure operated piston-in-cylinder arrangement in respect of each said pin.

21. A pellet mill in accordance with claim 13, wherein each of said pins comprises a piston rod, each of said piston rods being part of a piston-in-cylinder unit, there being inclined groove means formed in each of said pins, each of said piston-in-cylinder units having means for engaging with said groove means during axial movement of each piston rod for rotating said piston rod.

22. A pellet mill comprising a perforated annular pellet die having an axis of rotation and first and second ends;

a die carrier rotatable about an axis of rotation coincident with the axis of rotation of said pellet die, said die carrier having an annular recess for receiving said first end of said annular pellet die;

first fixing means secured to said first end of said die and including a peripheral end surface of the die;

releasable fixing means provided in said annular recess in said die carrier, said first fixing means and said releasable fixing means having a first position relative to one another permitting insertion of said first end into said annular recess by relative axial movement of said die toward said die carrier, and a second relative position of engagement of said first fixing means with said releasable fixing means permitting the transmission of force between said first fixing means and said releasable fixing means;

means for generating said force to draw said die towards said die carrier into said recess;

centering means operative during a drawing of said die towards said die carrier to center said die relative to said die carrier;

means for releasing said die from said die carrier; and wherein said first fixing means comprises screw thread means provided at said first end of said die, wherein said releasable fixing means comprises cooperating screw thread means provided in said annular recess, and wherein said die is movable by a relative rotational movement from said first relative position in which said screw thread means is not engaged with said cooperating screw thread means into said second relative position in which said screw thread means is engaged with said cooperating screw thread means.

23. A pellet mill in accordance with claim 22, wherein said screw thread means comprises a threaded ring at said first end of said die and wherein said cooperating screw thread means comprises a plurality of arcuate screw threaded segments provided within said annular recess, thereby permitting axial insertion of said first end of said die into said annular recess in a first relative position and relative rotational movement into said second relative position, with said die being simultaneously drawn towards said die carrier into a clamped position.

24. A pellet mill in accordance with claim 22, further comprising holding means; and wherein said relative rotational movement into said second relative position is produced by rotation of said die carrier while holding said die via said holding means.

25. A pellet mill in accordance with claim 24, further comprising position-shifting means, drive means and a torque transmitting mechanism; and wherein said drive means drives said die carrier via said torque transmitting mechanism; and said position-shifting means effects said relative rotational movement of said die into said second relative position via said torque transmission mechanism.

26. A pellet mill in accordance with claim 25, wherein said relative rotational movement into said second relative position is produced by said position-shifting means operating at a substantially slower speed than said drive means, and wherein said torque transmitting mechanism comprises switchable clutch means for selecting between said drive means and said position-shifting means.

27. A pellet mill in accordance with claim 26, wherein said position-shifting means operates via a reduction gearbox of said torque transmitting mechanism.

28. A pellet mill in accordance with claim 27, further comprising means for reversing the direction of said position-shifting means to release said die from said die carrier.

29. A pellet mill in accordance with claim 26, further comprising a position transducer connected to said position-shifting means for switching on said position-shifting means to produce said relative rotational movement of said die relative to said die carrier.

30. A pellet mill in accordance with claim 29, wherein said position transducer comprises a light source directed towards a circumferential portion of said die carrier, said circumferential portion carrying markings, and a sensor for receiving light reflected from said circumferential portion and modulated by said markings.

31. A pellet mill in accordance with claim 29, wherein said position transducer also controls movement of said clutch means.

32. A pellet mill in accordance with claim 30, wherein a switch is provided for bridging said sensor.

33. A pellet mill in accordance with claim 25, further comprising lifting means for lifting said die;

measuring means for measuring a force exerted on said lifting means during engagement of said die with said die carrier, said measuring means providing a signal indicating a magnitude of the force; and means for controlling said drive means in response to the signal of said measuring means.

34. A pellet mill in accordance with claim 33, comprising further control means for controlling said lifting means in response to the signal of said measuring means.

35. A pellet mill in accordance with claim 23, wherein said threaded segments in said annular recess are formed on a common support element of said die carrier.

36. A pellet mill in accordance with claim 35, further comprising means for fixedly connecting said common support element to said carrier.

37. A pellet mill in accordance with claim 22, wherein said cooperating screw thread means comprises a threaded ring disposed in said annular recess and wherein means is provided for producing at least limited rotation of said threaded ring about said rotational axis of said die carrier relative to said die carrier.

38. A pellet mill in accordance with claim 37, wherein said threaded ring has gear teeth; and said means for producing relative rotation of said threaded ring relative to said die carrier comprises a toothed pinion rotatably mounted in said die carrier and engaging with said gear teeth of said threaded ring.

39. A pellet mill in accordance with claim 38, further comprising means for manually rotating said pinion.

40. A pellet mill in accordance with claim 35, further comprising rotation means for producing rotation of said threaded ring relative to said die carrier, said rotation means comprising a worm gear rotatably mounted in said die carrier and engaging with a surface of said support element, said surface being formed, at least in part, as a worm wheel.

41. A pellet mill in accordance with claim 35, further comprising rotation means for producing relative rotation of said threaded ring, said rotation means comprising a screw threaded element directed substantially tangentially to said support element and cooperating with screw threads provided in said die carrier, said screw threaded element having an operating end engaging with an abutment provided on said threaded ring.

42. A pellet mill in accordance with claim 41, wherein said threaded element comprises a bolt having a head portion accessible from outside of said die carrier.

43. A pellet mill in accordance with claim 23, further comprising spring means in said die carrier for resiliently urging said threaded segments in said annular recess into said annular recess away from said first end of said die, said threaded segments being capable of limited axial displacement within said annular recess.

44. A pellet mill in accordance with claim 23, wherein said arcuate screw threaded segments within said annular recess are fixedly secured within said recess.

45. A pellet mill in accordance with claim 43, wherein said spring means comprises plate springs acting on said threaded segments via respective bolts.

46. A pellet mill in accordance with claim 45, wherein each said bolt comprises thread means engaging with one of said threaded segments and a head, with said plate springs being interposed between said die carrier and said heads on a side of said die carrier remote from said threaded segments.

47. A pellet mill in accordance with claim 23, wherein bolts are provided for pulling said threaded segments into said annular recess away from said die, each said bolt comprising a head braced against said die carrier at a side of said die carrier remote from said annular recess and a threaded portion engaged in the associated threaded segment; and wherein springs are provided between said threaded segments in said annular recess and said die carrier for resiliently urging said threaded segments in said annular recess towards said die to facilitate release of said die from said die carrier.

48. A pellet mill in accordance with claim 43, further comprising means in said die carrier for urging said threaded segments, in said annular recess, towards said die to facilitate release of said die from said die carrier.

49. A pellet mill in accordance with claim 48, wherein said means for urging said threaded segments in said annular recess towards said die comprises a hydraulic piston-in-cylinder unit in respect of each said threaded segment.

50. A pellet mill in accordance with claim 48, wherein said means for urging said threaded segments in said annular recess towards said die comprises, in respect of each said threaded segment, a pusher element displaceable by means of rotation of a screw thread.

51. A pellet mill in accordance with claim 23, wherein said threaded segments engage with said threaded ring secured to an end face of said die.

52. A pellet mill in accordance with claim 22, wherein said centering means comprises a conical surface provided in said annular recess and a cooperating conical surface provided at said first end of said die.

53. A pellet mill in accordance with claim 52, further comprising a ring member inserted into said annular recess; and wherein said conical surface in said annular recess is provided by a hollow conical surface of said ring member inserted into said annular recess.

54. A pellet mill in accordance with claim 53, wherein the relative rotational movement from said first relative position into said second relative position lies in the range from 15° to 100°.

55. A pellet mill in accordance with claim 23, wherein said screw thread means and said cooperating screw thread means comprise multi-start threads, the number of starts being equal to the number of threaded segments forming said cooperating screw thread means.

56. A pellet mill in accordance with claim 22, wherein said screw thread means comprises a first plurality of arcuate threaded segments at said first end of said die; and wherein said cooperating screw thread means on said die carrier comprises a second plurality of screw threaded segments provided within said annular recess on said die carrier; wherein non-threaded segments are provided between said threaded segments at said die and said threaded segments in said recess, thereby permitting axial insertion of said first end of said die into said annular recess in a first relative position in which non-threaded segments at said first end of said die are aligned with said threaded segments in said recess, and vice versa, and thereby permitting relative rotational movement into said second relative position by rotation of said threaded segments at said first end of said die relative to said threaded segments in said annular recess, with said die being simultaneously drawn towards said die carrier into a clamped position by cooperation of said screw threaded segments at said first end of said die and in said annular recess.

57. A pellet mill in accordance with claim 22, wherein said screw thread means and said cooperating screw thread means are formed as conical threads.

58. A pellet mill comprising a perforated annular pellet die having an axis of rotation and first and second ends;

a die carrier rotatable about an axis of rotation coincident with the axis of rotation of said pellet die, said die carrier having an annular recess for receiving said first end of said annular pellet die;

first fixing means secured to said first end of said die and including a peripheral end surface of the die; second fixing means provided in said annular recess in said die carrier;

said first fixing means and said second fixing means having a first position relative to one another permitting insertion of said first end into said annular recess by relative axial movement of said die toward said die carrier, and a second relative position of engagement of said first fixing means with said second fixing means permitting the transmission of force between said first fixing means and said second fixing means to draw said die towards said die carrier into a clamped position;

means for generating said force to draw said die towards said die carrier into said recess;

centering means to center said die relative to said die carrier;

wherein said first fixing means and said centering means include screw means on said die and said die carrier for screwing said die onto die carrier and drawing said die into said recess;

in operation of said pellet mill, said screw means absorbs the axial forces acting upon said die and said die carrier;

a hollow conical surface located on said die carrier and diverging towards said die, there being a corresponding conical surface of said die, said surfaces becoming engaged with each other upon said die being drawn into said recess, engagement of said surfaces providing for absorption of radial forces acting upon said die and said die carrier during operation of said pellet mill; and said screw means ensures automatic centering of said conical surface of said die within said hollow conical surface of said die carrier.

59. A pellet mill comprising a perforated annular pellet die having an axis of rotation and first and second ends;

a die carrier rotatable about an axis of rotation coincident with the axis of rotation of said pellet die, said die carrier having an annular recess for receiving said first end of said annular pellet die;

first fixing means secured to said first end of said die and including a peripheral end surface of the die;

second fixing means provided in said annular recess in said die carrier; and wherein said first fixing means and said second fixing means have a first position relative to one another permitting insertion of said first end into said annular recess by relative movement of said die toward said die carrier, said first and said second fixing means having a second relative position of engagement of said first fixing means with said second fixing means permitting the transmission of force between said first fixing means and said second fixing means to draw said die towards said die carrier into a clamped position;

means for generating said force to draw said die towards said die carrier into said recess;

wherein said first and second fixing means include screw means on said die and said die carrier for screwing said die onto said die carrier and drawing said die into said recess;

in operation of said pellet mill, said screw means absorbs the axial forces acting upon said die and said die carrier; and said mill further comprises means for releasing said die from said die carrier by imparting a positive releasing force to at least one of said screw means.

60. A pellet mill comprising a perforated annular pellet die having an axis of rotation and first and second ends;

a die carrier rotatable about an axis of rotation coincident with the axis of rotation of said pellet die, said die carrier having an annular recess for receiving said first end of said annular pellet die;

first fixing means secured to said first end of said die and including a peripheral end surface of the die;

second fixing means provided in said annular recess in said die carrier; and wherein said first fixing means and said second fixing means have a first position relative to one another permitting insertion of said first end into said annular recess by relative axial movement of said die toward said die carrier, and a second relative position of engagement of said first fixing means with said second fixing means permitting the transmission of force between said first fixing means and said second fixing means to draw said die towards said die carrier into a clamped position;

means for generating said force to draw said die towards said die carrier into said recess;

wherein said first and second fixing means include screw means on said die and said die carrier for screwing said die onto said die carrier and drawing said die into said recess; and in operation of said pellet mill, said screw means absorbs the axial forces acting upon said die and said die carrier, said screw means comprising multi-start threads.

61. A pellet mill comprising a perforated annular pellet die having an axis of rotation and first and second ends;

a die carrier rotatable about an axis of rotation coincident with the axis of rotation of said pellet die, said die carrier having an annular recess for receiving said first end of said annular pellet die;

drive means for imparting rotational movement to said die carrier;

first fixing means secured to said first end of said die and including a peripheral end surface of the die;

second fixing means provided in said annular recess in said die carrier; and wherein said first fixing means and said second fixing means have a first position relative to one another permitting insertion of said first end into said annular recess by relative axial movement of said die toward said die carrier, and a second relative position of engagement of said first fixing means with said second fixing means permitting the transmission of force between said first fixing means and said second fixing means to draw said die towards said die carrier into a clamped position;

means for generating said force to draw said die towards said die carrier into said recess;

wherein said first and said second fixing means include screw means on said die and said die carrier for screwing said die onto said die carrier and drawing said die into said recess; and in operation of said pellet mill, said screw means absorbs the axial forces acting upon said die and said die carrier; and said mill further comprises torque transmitting means for transmitting torque to said die carrier to effect a motion slower than a rotational movement of said drive means, and to thread said screw means of said die and said die carrier into full engagement with each other to draw said die into said recess.

62. A pellet mill comprising:

a perforated annular pellet die having an axis of rotation and first and second ends;

a die carrier rotatable about an axis of rotation and having an annular recess for receiving said first end of said annular pellet die;

first fixing means secured to said first end of said die;

second fixing means provided in said annular recess of said die carrier, said first fixing means and said second fixing means permitting insertion of said first end of said die into said annular recess by relative axial movement of said die and said die carrier; wherein, upon engagement of said first fixing means with said second fixing means, said first and said second fixing means provide for transmission of force between said first and said second fixing means to draw said die towards said die carrier;

means for generating said force for transmission between said first and said second fixing means;

centering means effective upon a drawing of said die towards said die carrier to center said die relative to said die carrier;

means for releasing said die from said die carrier; and wherein said first fixing means comprises a plurality of undercut apertures provided in an end face of said first end of said die;

said second fixing means comprises a plurality of first pins disposed parallel to said axis of said die and having heads engageable within said apertures;

said second fixing means further comprising means for rotating said first pins to engage said heads behind said apertures, said rotating means comprising further cooperating pin and inclined slot means for rotating said first pins and drawing said die towards said die carrier; and said centering means comprises a conical surface provided in said annular recess and a cooperating conical surface provided at said first end of said die.

* * * * *